United States Patent [19]

Tuggle et al.

[11] 4,413,371

[45] Nov. 8, 1983

[54] BLOWER ATTACHMENT FOR PORTABLE POWER UNIT

[75] Inventors: Lloyd H. Tuggle, Shreveport; Ronald C. Loyd, Keithville, both of La.

[73] Assignee: Emerson Electric Co., St. Louis, Mo.

[21] Appl. No.: 278,694

[22] Filed: Jun. 29, 1981

[51] Int. Cl.[3] ..... A47L 5/14

[52] U.S. Cl. ..... 15/405; 15/328

[58] Field of Search ..... 15/328, 338, 405; 173/163; 415/121 R; 417/234, 364

[56] References Cited

U.S. PATENT DOCUMENTS

| | | | |
|---|---|---|---|
| 4,132,507 | 1/1979 | Akiyama et al. | 15/405 X |
| 4,187,577 | 2/1980 | Hansen et al. | 15/405 X |
| 4,227,280 | 10/1980 | Comer | 15/405 X |
| 4,237,576 | 12/1980 | Stakes | 15/405 X |
| 4,269,571 | 5/1981 | Shikutani et al. | 417/234 |
| 4,288,886 | 9/1981 | Siegler | 15/405 X |

*Primary Examiner*—Chris K. Moore

*Attorney, Agent, or Firm*—Hubbard, Thurman, Turner & Tucker

[57] ABSTRACT

A lightweight air blower attachment for a portable power unit such as a hand held internal combustion engine. The blower attachment includes a generally tubular shaped housing adapted for close coupling of the blower to the power unit. The housing provides a shroud and a support for an axial flow impeller having a shaft which extends through a mounting boss on the housing and includes a drive tang adapted to be drivably connected to a power takeoff shaft. The blower includes an elongated nozzle having a handle portion and being rotatably mounted on the housing to provide for changing the direction of the exit air flow without rotating the entire power unit and blower attachment. The nozzle is provided with a conical portion which converges to a throat and transitions to a somewhat flat circular sector shaped air exit portion providing for an air flow pattern particularly adapted for sweeping and dusting operations.

18 Claims, 6 Drawing Figures

BLOWER ATTACHMENT FOR PORTABLE POWER UNIT

BACKGROUND OF THE INVENTION

1. Field of the Invention

The present invention pertains to an improved high volume air blower particularly adapted to be used as an attachment to a portable power supply unit such as a lightweight hand-held internal combustion engine.

2. Description of the Prior Art

It is known to use apparatus capable of producing relatively high-velocity, low-pressure air flow for sweeping large outdoor surface areas and for dusting and drying virtually any object or surface capable of being so treated. One well known method of sweeping with a jet of air involves simply using a nozzle connected to an air hose which in turn must, of course, be connected to a source of compressed air such as a portable or stationary air compressor.

The convenience of using a high velocity air stream for sweeping large surfaces has led to the development of portable air blower type sweepers which are characterized by a relatively small internal combustion engine driving a fan and adapted to be worn on the back of the operator. The blower output air flow is conducted through a flexible hose to a nozzle which is handled by the operator. Still other types of so called portable air blower sweepers are known which are relatively heavy and must be mounted on wheels or casters to be towed or pushed along the surface to be cleaned.

Known types of air blower sweepers have been found to be somewhat heavy and bulky and not well suited to handheld operation for directing the air flow stream in any desired direction. Known types of air blower sweepers have also been compromised by the design of the power supply unit which, in most cases, has been adapted basically for use with other types of attachments or power consuming apparatus.

SUMMARY OF THE INVENTION

The present invention represents an improvement in air blower type sweepers in that there is provided a high volume flow rate air blower which is compact, lightweight, and adapted to be removably close coupled to the power takeoff shaft of a portable power supply unit.

The air blower of the present invention may be advantageously used in connection with a separate and superior handheld power unit or so-called power handle of a type disclosed and claimed in U.S. patent application Ser. No. 051,950 which is assigned to the assignee of the present invention.

The air blower of the present invention is further advantageously characterized by a small number of separate parts, most of which may be economically manufactured of a suitable molded plastic.

The air blower of the present invention includes a compact housing adapted to be removably close coupled to the power takeoff shaft of a portable power handle of the type disclosed in the above mentioned patent application, said housing further comprising mounting means and a shroud for a single stage axial flow fan.

The air blower of the present invention is still further advantageously characterized by an elongated nozzle which is mounted on the blower housing and includes a hand grip portion which improves the handling characteristics of the complete blower and power supply unit.

The blower nozzle is of the convergent-divergent type and is provided with a somewhat flattened circular sector shaped outlet portion to provide for a relatively thin and wide flow stream useful in sweeping large surfaces such as sidewalks, pedestrian malls, parking lots, and the like. The nozzle portion of the air blower of the present invention is rotatably mounted with respect to the blower housing and the power handle to further improve the handling characteristics of the complete unit.

One advantage of the present invention is that there is provided a compact and more easily handled portable air blower type sweeper and duster than has been heretofore known.

Another advantage of the present invention is that an air blower is provided which is adapted to be a quick releasable attachment for a portable power unit of a type which can be easily hand carried and manipulated and is adaptable to be used with a variety of other work performing implements.

A still further advantage of the present invention is that an air blower type sweeper is provided which is mechanically uncomplicated, economical to manufacture, and durable in use.

The above mentioned superior features and advantages of the present invention may be further realized and appreciated upon reading the detailed description herein in conjunction with the drawings.

DESCRIPTION OF THE PREFERRED EMBODIMENT

Figure 1:
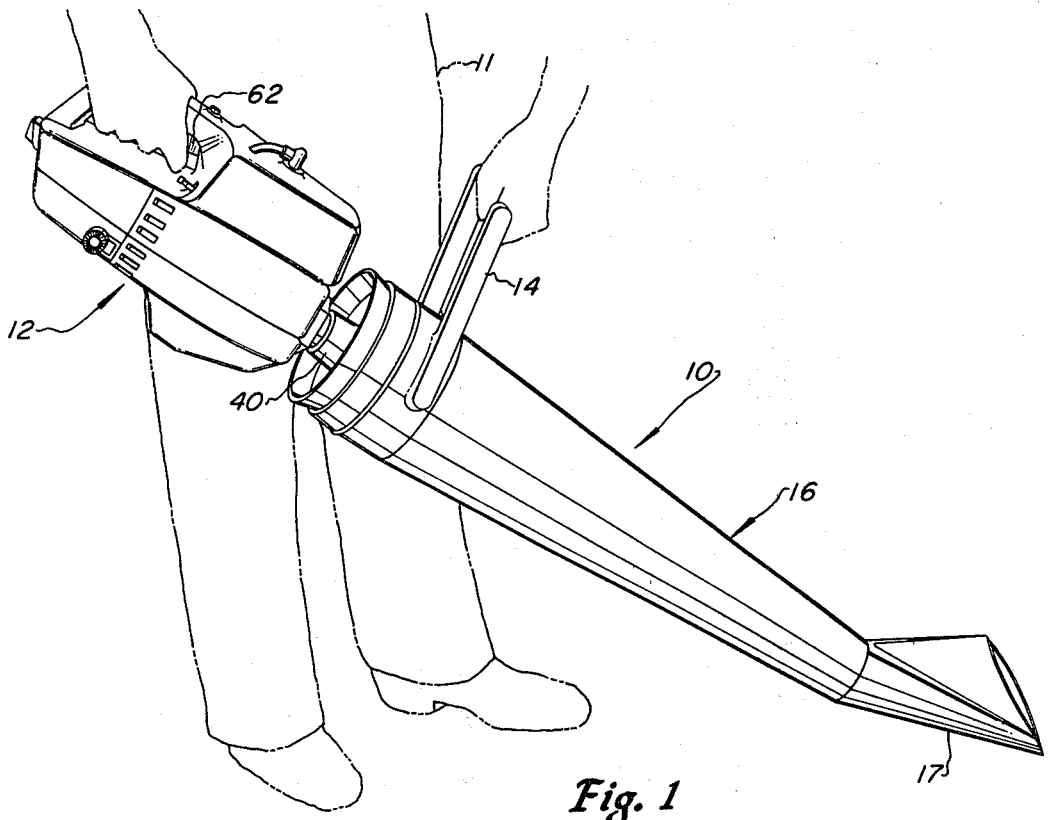
FIG. 1 is a perspective view showing an operator holding the air blower of the present invention connected to a preferred type of portable power unit.

In the description which follows like parts are indicated throughout the specification with the same reference numerals, respectively.

Figure 6:
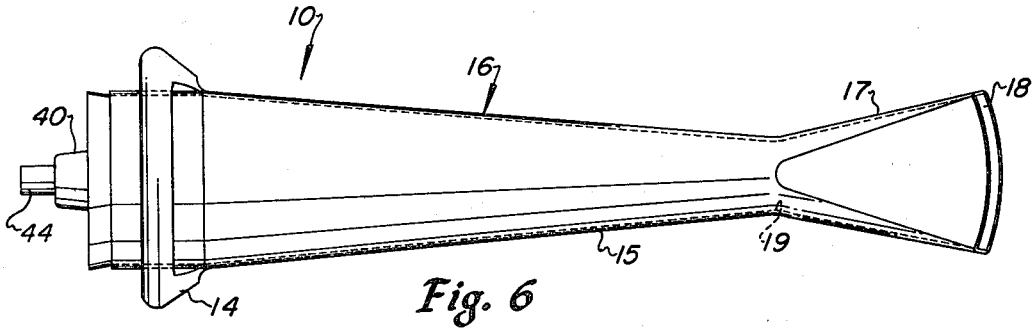

Referring to FIG. 1 the portable blower of the present invention is generally designated by the numeral 10. The blower 10 is shown coupled to a novel lightweight and compact power unit comprising an internal combustion engine preferably of the gasoline powered two stroke type. The so-called power handle shown, and generally designed by the numeral 12, is disclosed in greater detail in the aforementioned co-pending patent application. The blower 10 is provided with a handle 14 which is attached to or preferably formed as an integral part of an elongated generally conical convergent-divergent nozzle 16. As shown also in FIG. 6 the nozzle 16 is provided with a somewhat circular sector shaped outlet portion 17 having an air outlet opening 18 formed therein. The particular configuration of the outlet portion 17 of the nozzle shown in FIG. 1 and FIG. 6 provides for a relatively wide and thin air flow stream which is advantageous for surface sweeping operations. Other nozzle outlet configurations may be provided for particular flow patterns desired. As may be appreciated viewing FIG. 1 the blower 10, in combination with the power handle 12, provides a compact easily manipulated portable sweeper or dusting device which may be hand held and operated by an operator 11.

Figure 2:
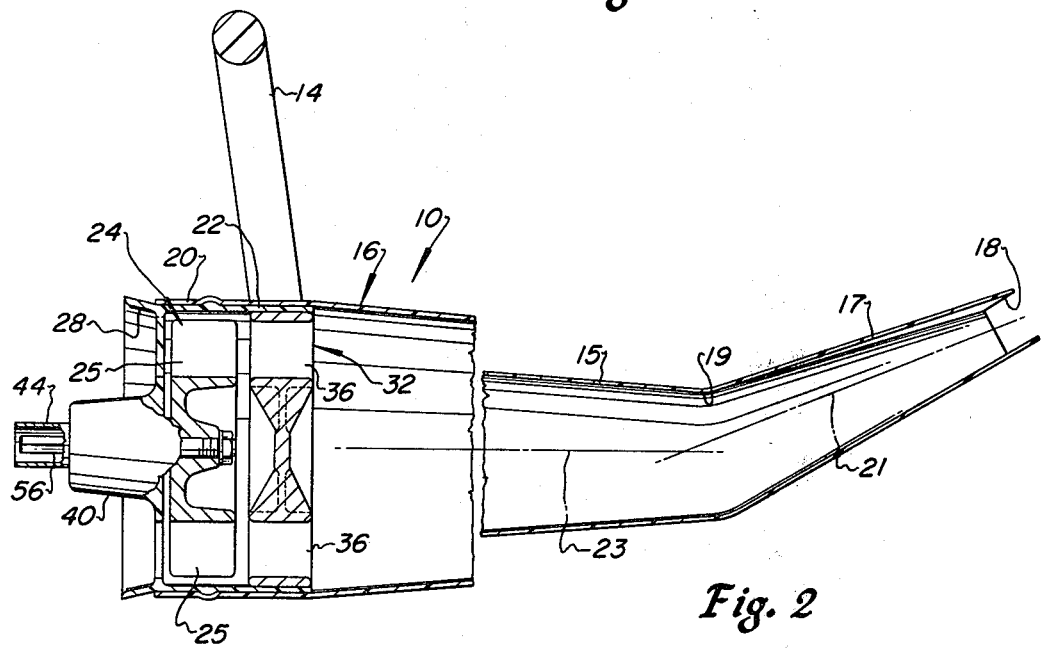
FIG. 2 is a broken longitudinal section view of the air blower of the present invention.
Figure 3:
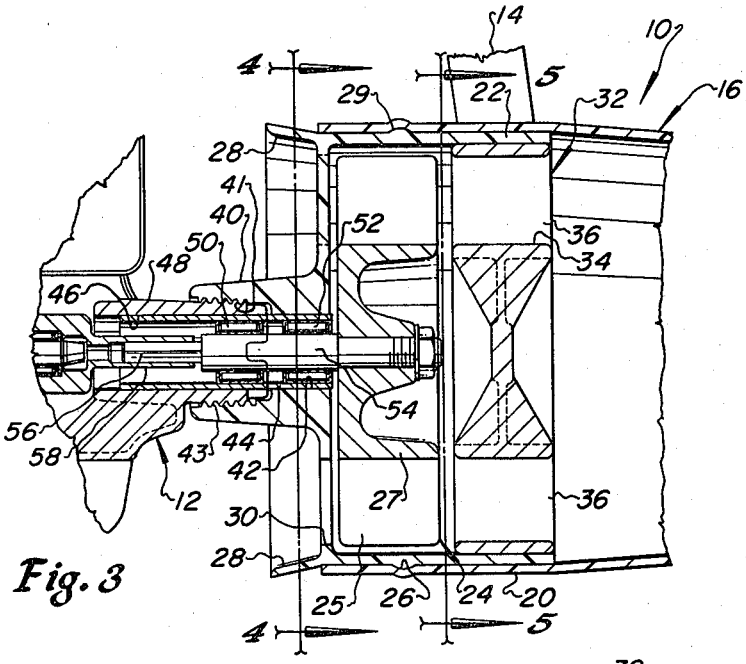
FIG. 3 is a longitudinal section view of a portion of the air blower showing details of the coupling arrangement with the preferred type of portable power unit.

Referring now to FIGS. 2 and 3 also, the nozzle 16 includes a generally cylindrical portion 20 at the blower inlet end. The nozzle 16 is adapted to be rotatably fitted over the exterior cylindrical surface of a housing 22. As shown in FIGS. 2 and 3, the housing 22 and nozzle 16 may be provided, respectively, with a cooperating circumferential ridge 29 and groove 26 to prevent unwanted removal of the nozzle from the housing. The nozzle 16 may be formed of a suitable molded plastic which may be elastically deformed to provide for attachment and removal of the nozzle with respect to the housing. Alternatively, the nozzle and housing may be provided with cooperating cylindrical surfaces which are dimensioned for a snug but movable fit of the nozzle over the housing so that the nozzle may be rotated with respect to the power handle to change the direction of the air outlet flow stream and aid in the manipulation of the entire blower and power handle unit.

Referring further to FIG. 2, the nozzle 16 includes a substantially conical portion 15 which tapers to a throat 19 and then transitions to the circular sector outlet portion 17. The outlet portion 17 is formed to have a central axis 21 of the flow area which is at an angle with respect to the longitudinal axis 23 of the conical portion of the nozzle. The bend in the nozzle 16 formed at the transition from the conical portion 15 to the circular sector portion 17 provides for directing the air outlet flow stream at a suitable angle with respect to the ground without having to hold the power handle in an awkward and uncomfortable position for sweeping operations.

Figure 4:
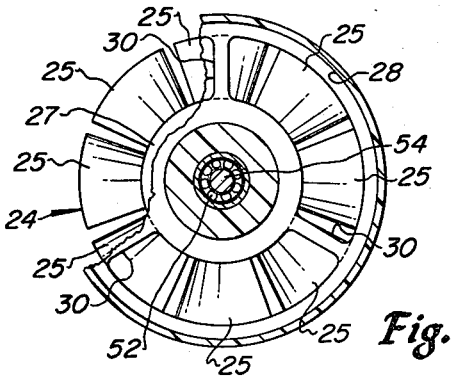
FIG. 4 is a section view taken from line 4—4 of FIG. 3 and showing a portion of the blower housing broken away.
Figure 5:
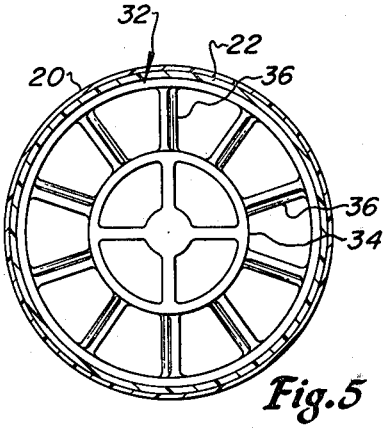
FIG. 5 is a section view taken from the line 5—5 of FIG. 3; and, FIG. 6 is a longitudinal plan view of the air blower of the present invention.

The housing 22 comprises mounting means and a shroud for an axial flow fan impeller 24. The housing 22 also includes a slightly conically flared inlet flange 28 and, as shown in FIG. 4 also, three equally spaced air inlet openings 30 to the impeller 24. Referring to FIGS. 2, 3 and 5 the housing 22 is further provided with a stator section 32 having a hub 34 and a plurality of equally spaced radially extending flow straightener vanes 36 extending from the hub to a circumferential shroud portion. The stator section 32 is preferably formed of molded plastic and is adapted to be removably press fitted into the housing 22.

Referring particularly to FIG. 3, the housing 22 still further includes an integral axially projecting boss 40 which is provided with a cylindrical bore 42 in which is fixed a metal sleeve 44. The sleeve 44 is operable to extend into a cooperating bore 46 in a mounting boss 48 on the power handle 12. The bosses 40 and 48 are provided with cooperating internal and external threads, 41 and 43, respectively, providing for easily removably attaching the blower 10 to the power handle 12. Alternatively, the boss 48 could have an axial groove along one side and a transversely extending bolt arrangement to provide means for clamping the sleeve 44 to the power handle 12 in a manner similar to the clamping arrangement shown in U.S. patent application Ser. No. 210,028 assigned to the assignee of the present invention.

The sleeve 44 supports suitable spaced apart bearings 50 and 52 which in turn rotatably support a drive shaft 54 which is bolted to the impeller 24 as shown. The drive shaft 54 includes a drive tang 56 which is adapted to be drivably fitted into a complementary socket in a power take off shaft 58 of the power handle 12. The bearings 50 and 52 may be rolling element bearings provided with inner and outer races so that the drive shaft 54 may be retained in the sleeve 44 by suitable press fitting of the shaft in the bores of the bearing inner races. The bearings outer races may be suitably press fitted in the bore of the sleeve 44.

Referring again to FIGS. 3 and 4 the impeller 24 is preferably provided with a plurality of radially extending airfoil shaped blades 25 which are integrally formed with a hub portion 27 and are preferably designed in accordance with aerodynamic principles. The impeller 24 is thus a high capacity type fan which may be manufactured in one piece of molded plastic or cast aluminum, for example.

The blower 10 of the present invention may be easily connected to and removed from the power handle 12 by merely threading the housing 22 on to or off of the boss 48. In operation, the power handle 12 is run over its speed range by a suitable digitally actuated throttle lever 62 as shown in FIG. 1. The impeller 24, being directly connected to the power handle power takeoff shaft, will provide air flow proportional to engine speed. The relatively high efficiency axial flow impeller together with the flow straightener vanes in the stator section provides a suitable pressure rise which in combination with the nozzle 16 will provide nozzle exit velocities suitable for sweeping, dusting or other air blast cleaning operations. Moreover, by providing for the nozzle 16 to be rotatable with respect to the blower housing 22 and the power handle 12 greater ease of handling and use of the blower is obtained.

What we claim is:

1. An air blower attachment for a portable power supply unit comprising:

a housing including means forming an air inlet opening;

an impeller rotatably mounted in said housing and including shaft means operable to be drivably connected to power takeoff shaft means on said power supply unit; and means for coupling said air blower to said power supply unit comprising a boss on said power supply unit including a longitudinal bore, and a tubular sleeve secured to and extending from one end of said housing and adapted to be inserted in said bore in said boss in close fitting engagement with said boss, said impeller shaft means extending within said tubular sleeve into engagement with said power takeoff shaft means.

2. The invention set forth in claim 1 wherein:

said impeller comprises a multibladed axial flow fan.

3. The invention set forth in claim 2 wherein:

said housing comprises a tubular portion forming a shroud for said impeller.

4. The invention set forth in claim 3 together with:

a stator section disposed in said housing adjacent to and downstream of said impeller.

5. The invention set forth in claim 1 wherein:

said nozzle includes a portion comprising means for rotatably mounting said nozzle on said housing.

6. An air blower for attachment to a portable power supply unit comprising an internal combustion engine having a power takeoff shaft provided with a socket, and a boss disposed coaxially with said power takeoff shaft, said boss having a cylindrical bore and exterior threads formed on said boss, said air blower including a housing including means for threadably engaging the exterior threads on said boss to secure said air blower to said power supply unit, a drive shaft rotatably supported on said housing for engagement by the power takeoff shaft, and air moving impeller means secured to and driven by said drive shaft.

7. The air blower set forth in claim 6 wherein:

said housing further includes a tubular section for insertion in the cylindrical bore of said boss and forming a pilot portion for aligning said drive shaft with said power takeoff shaft.

8. The invention set forth in claim 7 wherein:

said drive shaft is rotatably mounted on said housing and includes a drive tang adapted to be inserted in said socket in said power takeoff shaft.

9. The invention set forth in claim 8 wherein:

said thread engaging means of said housing includes an axially projecting boss including an internal threaded portion for threadedly engaging the exterior threads on said boss on said power supply unit, and said tubular section comprises a tubular sleeve extending coaxially within said internal threaded portion for insertion in said bore when said bosses are threadedly engaged.

10. The invention set forth in claim 9 wherein:

said drive shaft is mounted coaxially within said tubular sleeve.

11. An air blower for attachment to a portable power supply unit and comprising:

a housing including means forming an air inlet opening;

an impeller rotatably mounted in said housing and including shaft means operable to be drivably engaged by power takeoff shaft means on said power supply unit;

a boss on said housing having a threaded portion operable to be threadably engaged with a complementary boss on said power supply unit for coupling said air blower to said power supply unit; and an elongated nozzle connected to said housing and having an outlet opening for an air flow stream generated by said impeller.

12. The air blower set forth in claim 11 wherein:

said housing includes a tubular sleeve at one end of said housing and including a portion extending into a bore in said boss on said power supply unit.

13. An air blower for attachment to a portable power supply unit and comprising:

a housing including means forming an air inlet opening;

an axial flow impeller rotatably mounted in said housing and including shaft means operable to be drivably engaged by power takeoff shaft means on said power supply unit;

a tubular portion of said housing forming a shroud for said impeller;

a boss on said housing having a portion operable to be engaged with a complementary boss on said power supply unit for coupling said blower to said power supply unit;

a stator section disposed in said housing adjacent to and downstream of said impeller; and an elongated nozzle mounted on said housing and having an outlet opening for an air flow stream generated by said impeller.

14. The air blower set forth in claim 13 wherein:

said nozzle includes an elongated generally conical convergent portion, a throat formed at one end of said convergent portion, and a divergent portion of said nozzle extending from said throat to an outlet opening in said nozzle for discharging air from said nozzle.

15. The air blower set forth in claim 14 wherein:

said divergent portion of said nozzle has a central longitudinal axis formed at an angle with regard to the longitudinal central axis of said conical portion of said nozzle.

16. The air blower set forth in claim 13 wherein:

said nozzle includes a handle portion for holding said air blower, and means for rotatably supporting said nozzle on said housing so that said nozzle may be rotated with respect to said power supply unit to change the direction of said air flow stream.

17. The air blower set forth in claim 1 wherein:

said impeller shaft means includes an axially projecting drive tang adapted to be drivably fitted into a complementary drive socket in said power takeoff shaft means.

18. The air blower set forth in claim 17 wherein:

said impeller shaft means is rotatably mounted on bearing means supported in said tubular sleeve.

* * * * *